US005960569A

United States Patent [19]

Molstad

[11] Patent Number: 5,960,569

[45] Date of Patent: Oct. 5, 1999

[54] ARTICULATED DOZER BLADE SYSTEM FOR VEHICLES

[76] Inventor: Don Molstad, 800 S. Marion Rd., Sioux Falls, S. Dak. 57106

[21] Appl. No.: 08/897,612

[22] Filed: Jul. 21, 1997

[51] Int. Cl.[6] ..... E01H 5/04

[52] U.S. Cl. ..... 37/231; 37/232; 37/273; 172/816

[58] Field of Search ..... 37/272, 273, 264, 37/233, 232, 274, 231; 172/811, 816, 813, 821

[56] References Cited

U.S. PATENT DOCUMENTS

| | | |
|---|---|---|
| D. 275,957 | 10/1984 | Sterrett . |
| D. 323,660 | 2/1992 | Bolduce et al. . |
| 574,567 | 1/1897 | Pepin . |
| 595,202 | 12/1897 | Pearson et al. . |
| 1,307,410 | 6/1919 | Morris . |
| 1,365,153 | 1/1921 | Clark . |
| 1,453,811 | 5/1923 | Starkweather . |
| 1,455,494 | 5/1923 | Johnson . |
| 1,570,267 | 1/1926 | MacKenzie . |
| 1,927,078 | 9/1933 | Weeks . |
| 1,957,103 | 5/1934 | Frink . |
| 2,059,431 | 11/1936 | Barrett et al. . |
| 2,078,294 | 4/1937 | Stiehl et al. . |
| 2,218,512 | 10/1940 | Ball . |
| 2,219,159 | 10/1940 | Flynn et al. . |
| 2,502,681 | 4/1950 | Swanson . |
| 2,577,145 | 12/1951 | Nearing et al. . |
| 2,590,143 | 3/1952 | Adams et al. . |
| 2,643,470 | 6/1953 | Kaeser . |
| 2,643,472 | 6/1953 | Merz . |
| 2,645,043 | 6/1953 | Booton et al. . |
| 2,667,708 | 2/1954 | Gjesdahl . |
| 2,698,096 | 12/1954 | Hughes . |
| 2,698,491 | 1/1955 | Felt . |
| 2,702,212 | 2/1955 | McAneny . |
| 2,793,880 | 5/1957 | Oehler et al. . |
| 2,904,116 | 9/1959 | Wessendorf . |
| 2,974,762 | 3/1961 | Hunnebeck . |
| 3,019,536 | 2/1962 | Kershaw . |
| 3,157,099 | 11/1964 | Ulrich . |
| 3,201,878 | 8/1965 | Markwardt . |
| 3,250,026 | 5/1966 | Jocher et al. . |
| 3,307,275 | 3/1967 | Simi . |
| 3,365,822 | 1/1968 | Howie . |
| 3,378,084 | 4/1968 | Ulrich . |
| 3,388,929 | 6/1968 | Miley . |
| 3,410,008 | 11/1968 | Standfuss . |
| 3,425,497 | 2/1969 | Strabala et al. . |
| 3,432,949 | 3/1969 | Glesmann . |
| 3,512,804 | 5/1970 | Siegert . |
| 3,706,144 | 12/1972 | Miceli . |
| 3,803,733 | 4/1974 | Ramsey . |
| 3,845,577 | 11/1974 | Naymik . |
| 3,881,261 | 5/1975 | Lavoie . |
| 3,898,753 | 8/1975 | Kinnunen . |
| 3,964,622 | 6/1976 | Blair et al. . |
| 3,987,562 | 10/1976 | Deen et al. . |
| 4,056,250 | 11/1977 | Uchiyama . |
| 4,074,448 | 2/1978 | Niemela . |
| 4,135,583 | 1/1979 | Becker . |
| 4,216,833 | 8/1980 | Fezatt et al. . |
| 4,311,200 | 1/1982 | Lebedev et al. . |
| 4,320,589 | 3/1982 | Pelazza . |
| 4,356,645 | 11/1982 | Hine et al. . |
| 4,384,620 | 5/1983 | Uchida et al. . |
| 4,552,226 | 11/1985 | Platter . |
| 4,597,202 | 7/1986 | Weeks . |
| 4,597,205 | 7/1986 | Guest ..... 172/273 X |
| 4,614,048 | 9/1986 | Melby . |

(List continued on next page.)

*Primary Examiner*—H. Shackelford

[57] ABSTRACT

An articulated dozer blade system for vehicles for performing dozing operations using an articulated blade capable of a variety of blade configurations. The inventive device includes an articulated dozer blade portions pivotally mounted together and mounted to a central pivot member. The central pivot member is mounted to a support structure by a bifurcated pivot mounting comprised of spaced fork members having a pivot rod which passes through the outer walls of the central pivot member. Blade positioning members secure the blade portions at a user-selected setting.

20 Claims, 4 Drawing Sheets

U.S. PATENT DOCUMENTS 4,658,519 4/1987 Quenzi ..... 37/273 X
4,813,164 3/1989 Morrell .
4,843,744 7/1989 Jansen .
4,962,599 10/1990 Harris ..... 37/266
5,148,617 9/1992 Feller et al. .
5,285,588 2/1994 Niemela et al. .
5,329,708 7/1994 Segorski et al. ..... 37/231

ARTICULATED DOZER BLADE SYSTEM FOR VEHICLES

BACKGROUND OF THE INVENTION

1. Field of the Invention

The present invention relates to articulated plow blade devices and more particularly pertains to a new articulated dozer blade system for vehicles for performing dozing operations using an articulated blade capable of a variety of blade configurations.

2. Description of the Prior Art

Articulated plow blade devices for system on vehicles are known, and these devices have primarily been designed and used for plowing or pushing snow or other relatively light-weight friable materials. The desire to removably mount these devices on nondedicated vehicles (such as pickup truck vehicles) has required that the devices be kept relatively light in weight, which has limited the strength and durability of the devices, especially when they are used to plow friable materials that are denser (e.g., heavier) than snow, such as soil, sand or stone.

The design of these devices has also limited their usage as a "dozer" blade, such as use in a manner similar to traditional bulldozers, for spreading out and leveling out friable material. Dozer blading is a much more rigorous operation than simply pushing material such as snow in front of the blade. Typical dozer operations, such as dragging the blade backwards (known as "back-dragging") over a quantity of friable material to level out the material on the ground surface (including paved and unpaved surfaces), requires a significant amount of strength in the blade structure that these plow blade devices have typically lacked.

Further, back dragging operations require the ability to securely fix the blade against swinging movement (about a vertical axis) and against pivoting movement (about a horizontal axis), sometimes referred to as "tripping". For example, the use of springs on previous devices to pivotally bias the swing movement of the individual blade portions severely limits the ability of these devices to perform the back dragging operation. Thus, the use of previous articulated plow blade devices in operations other than snow removal has been quite limited.

Additionally, the "tripping" of the blade about a transverse horizontal axis (for accommodating obstacles encountered by the bottom edge of the blade on the ground surface) is useful for snow moving when ground obstacles may be hidden by snow covering the ground. However, the tripping feature reduces the effectiveness of the blade when attempting to move heavier materials such as dirt, sand, and rock.

The articulated dozer blade system for vehicles according to the present invention substantially departs from the conventional concepts and designs of the prior art, and in so doing provides an apparatus primarily developed for the purpose of performing dozing operations using an articulated blade capable of a variety of blade configurations.

SUMMARY OF THE INVENTION

In view of the foregoing disadvantages inherent in the known types of articulated plow blade devices now present in the prior art, the present invention provides a new articulated dozer blade system wherein the same can be utilized for performing dozing operations using an articulated blade capable of a variety of blade configurations.

The general purpose of the present invention, which will be described subsequently in greater detail, is to provide a new articulated dozer blade system for vehicles which has many of the advantages of the articulated plow blade devices mentioned heretofore and many novel features that result in a new articulated dozer blade system for vehicles which is not anticipated, rendered obvious, suggested, or even implied by any of the prior art articulated plow blade devices, either alone or in any combination thereof.

To attain this, the articulated dozer blade system for attachment to a vehicle of the present invention generally comprises an articulated dozer blade having left and right dozer blade portions pivotally mounted together at a central swing joint such that the dozer blade portions are swingable between a forward swing position substantially forward of the central swing joint and a rearward swing position substantially rearward of the central swing joint. A central pivot member is located rearward of the articulated dozer blade and has the central swing joint of the articulated dozer blade mounted thereon, and the central pivot member has laterally spaced outer walls extending rearwardly from the mounting of the central swing joint. Blade positioning means are provided for independently swinging each dozer blade portion relative to the central pivot member to a user-selected position between the forward swing position and the rearward swing position. The blade positioning means are adapted to securely hold each dozer blade portion in a user-selected position to thereby resist forward and rearward swinging of a dozer blade portion from the selected position.

A dozer blade support structure is provided for supportively attaching the dozer blade and the central pivot member to a vehicle. The support structure has a forward end and a rearward end, with the rearward end having attachment means for attaching the support structure to a vehicle. A bifurcated pivot mounting is provided for pivotally mounting the central pivot member on the support structure, and the bifurcated pivot mounting comprises a pivot rod mounting sleeve extending between and through the laterally-spaced outer walls of the central pivot member. The mounting sleeve is mounted at its opposite end portions to the laterally-spaced outer walls. The central pivot member has a rear wall extending between and being fixed to the laterally-spaced outer walls and being fixed to the pivot rod mounting sleeve. The bifurcated pivot mounting further comprises laterally-spaced parallel fork members extending forwardly from the forward end of the support structure, with each fork member having a pivot rod mounting bushing mounted thereon. The central pivot member is positioned between the spaced fork members such that the pivot rod mounting sleeve thereof aligns with the pivot rod mounting bushings of the fork members. A pivot rod having end portions is received in the pivot rod mounting bushings and extends through the mounting sleeve of the central pivot member and the mounting bushing of each fork member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new articulated dozer blade system for vehicles which has many of the advantages of the articulated plow blade devices mentioned heretofore and many novel features that result in a new articulated dozer blade system for vehicles which is not anticipated, rendered obvious, suggested, or even implied by any of the prior art articulated plow blade devices, either alone or in any combination thereof.

It is another object of the present invention to provide a new articulated dozer blade system for vehicles which may be easily and efficiently manufactured and marketed.

It is a further object of the present invention to provide a new articulated dozer blade system for vehicles which is of a durable and reliable construction.

An even further object of the present invention is to provide a new articulated dozer blade system for vehicles which is susceptible of a low cost of manufacture with regard to both materials and labor, and which accordingly is then susceptible of low prices of sale to the consuming public, thereby making such articulated dozer blade system for vehicles economically available to the buying public.

Still yet another object of the present invention is to provide a new articulated dozer blade system for vehicles which provides in the apparatuses and methods of the prior art some of the advantages thereof, while simultaneously overcoming some of the disadvantages normally associated therewith.

Still another object of the present invention is to provide a new articulated dozer blade system for vehicles for performing dozing operations using an articulated blade capable of a variety of blade configurations.

Yet another object of the present invention is to provide a new articulated dozer blade system for vehicles which includes articulated blade portions independently swingable relative to a central pivot member to a user-selected position, with the position being securely held by each dozer blade portion in the user-selected position in a manner resisting forward and rearward swinging of each dozer blade portion from the selected position.

Still yet another object of the present invention is to provide a new articulated dozer blade system for vehicles that has enhanced strength and durability for greater versatility of use.

Even still another object of the present invention is to provide a new articulated dozer blade system for vehicles that performs plow blading operations including pushing a friable material such as snow from a ground surface, and performs dozer blading operations including distributing and leveling out a friable material such as dirt or sand over a ground surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
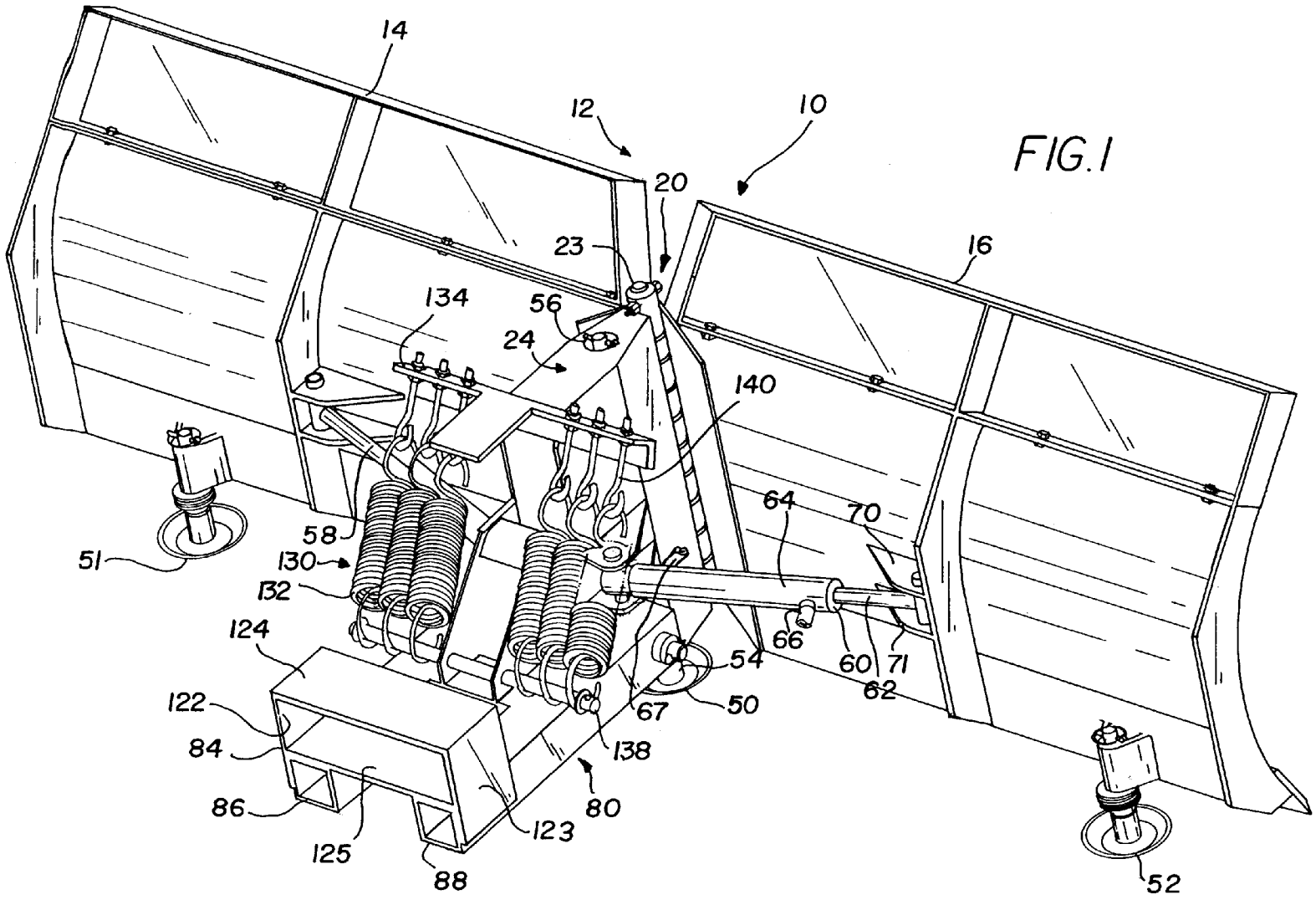
FIG. 1 is a schematic rear perspective view of a new articulated dozer blade system for vehicles according to the present invention.
Figure 2:
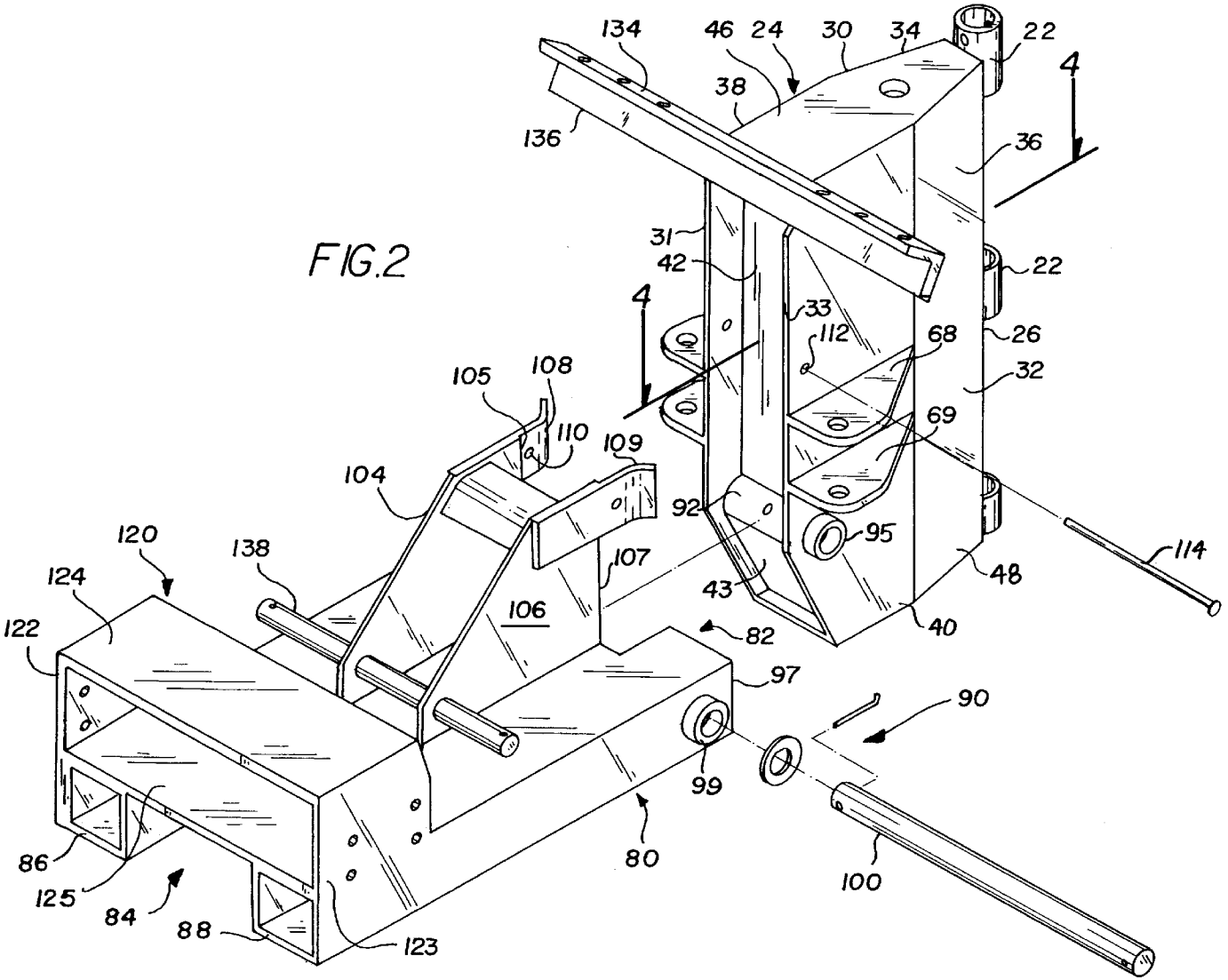
FIG. 2 is a schematic exploded perspective view of the central pivot member and the support structure isolated from the other components of the invention.
Figure 3:
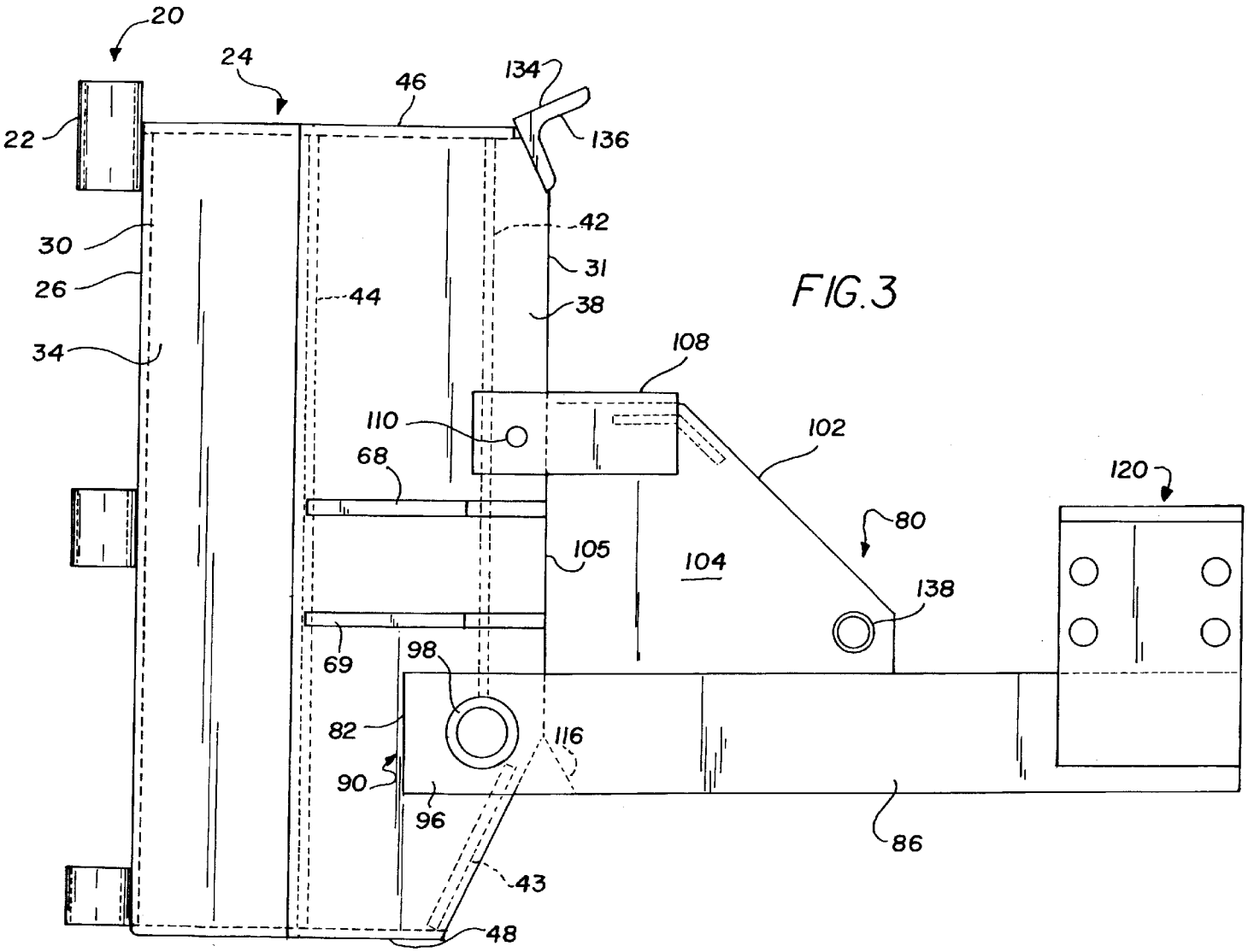
FIG. 3 is a schematic side view of the isolated central pivot member and support structure in an operational pivot position.
Figure 4:
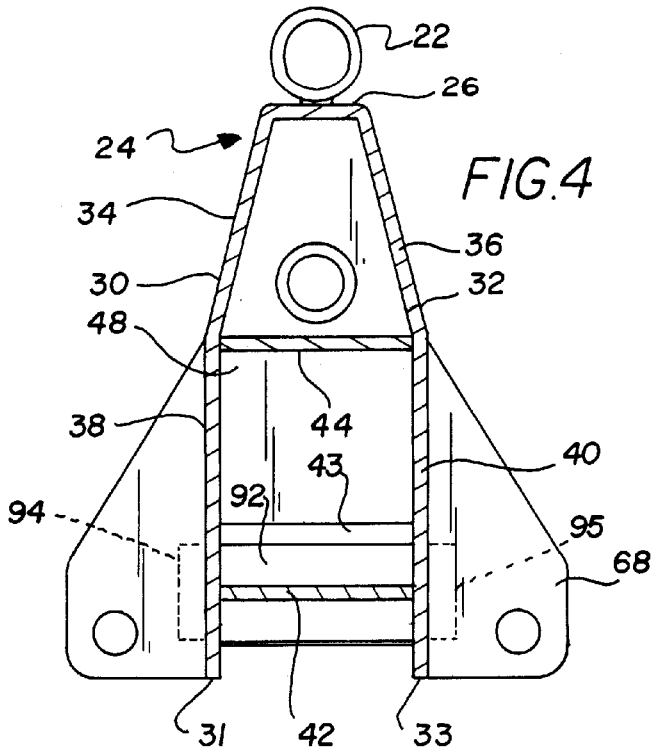
FIG. 4 is a schematic sectional view of the central pivot member taken along line 4—4 of FIG. 2.
Figure 5:
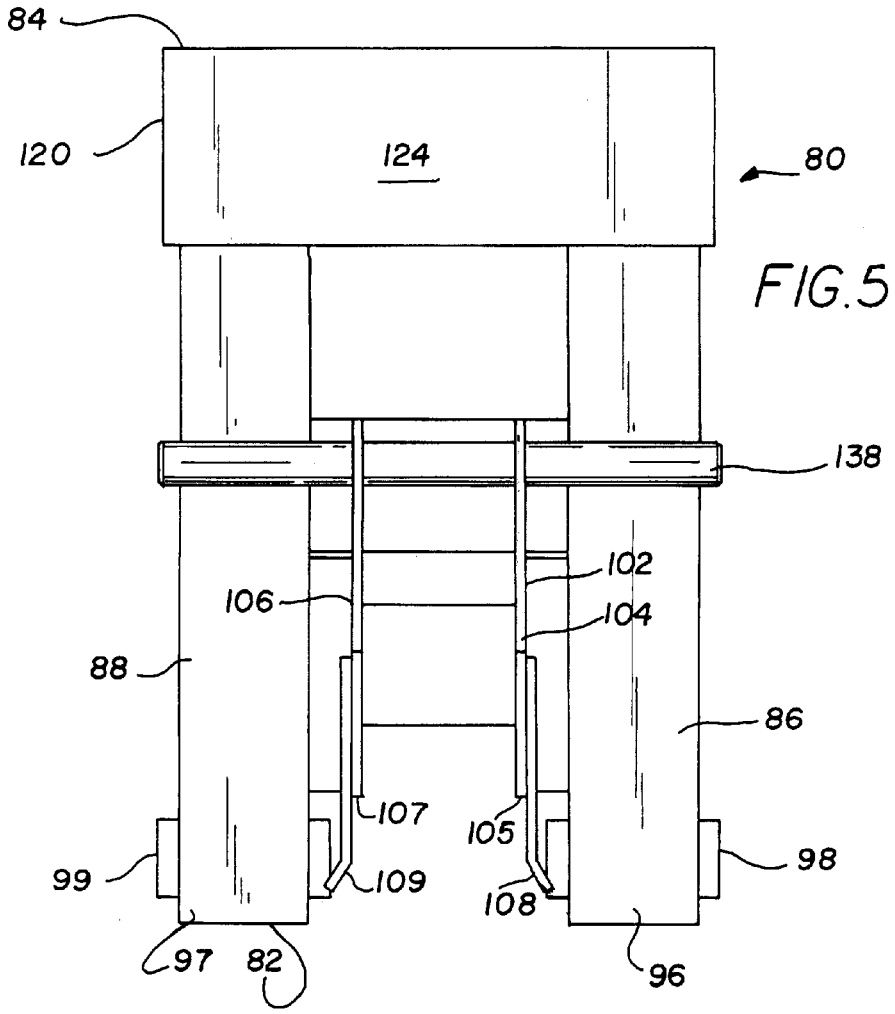
FIG. 5 is a schematic top view of the support structure in isolation.

With reference now to the drawings, and in particular to FIGS. 1 through 5 thereof, a new articulated dozer blade system for vehicles embodying the principles and concepts of the present invention and generally designated by the reference numeral 10 will be described.

The invention comprises an articulated dozer blade system 10 for attachment to a vehicle that is suitable (e.g., possesses the necessary power) for pushing and for bulldozing (or simply "dozing") relatively loosely packed friable material, such as, for example, a skid steer loader or other vehicle, and is ideally suited for use with vehicles having a raisable and lowerable tool mounting platform (not shown).

The system 10 generally comprises an articulated dozer blade 12, a central pivot member 24 on which the articulated dozer blade 12 is mounted, and a support structure 80 having the central pivot member 24 pivotally mounted thereon. For purposes of description, the dozer blade 12 is considered forward of the central pivot member 24, and the central pivot member is forward of the support structure 80. The vehicle (not shown) on which the system 10 is mounted is rearward of the system 10.

The articulated dozer blade 12 comprises left 14 and right 16 dozer blade portions that are pivotally mounted together at a central swing joint 20. This pivotal mounting permits each of the dozer blade portions 14, 16 to swing to an infinite number of positions between a forward swing position in which the blade portion is located substantially ahead of or forward of the central swing joint 20, and a rearward swing position in which the blade portion is located substantially behind or rearward of the central swing joint.

The central pivot member 24 is located rearward of the articulated dozer blade 12 and directly behind the central swing joint 20 of the articulated dozer blade 12.

The preferred central pivot member 24 of the invention is comprised of a number of discrete walls or plates that are joined together in a suitable manner such as by substantially continuous welds along the portions of the walls that meet. The central pivot member 24 has a front wall 26 that is oriented substantially transversely to the longitudinal axis of the central pivot member. The substantially vertically-oriented front wall 26 also has the central swing joint 20 mounted thereon.

Most preferably, the central swing joint 20 comprises a plurality of discrete pivot sleeves 22, with the dozer blade portions 14, 16 and the front wall 26 of the central pivot member 24 each having at least one of the pivot sleeves being mounted thereon. Ideally, the holes in the pivot sleeves 22 are alignable with each other in an alternating manner. A swing pin 23 is inserted through the holes of the pivot sleeves 22 to pivotally join the sleeves together and allow the central pivot member 24 and the dozer blade portions 14, 16 to pivot or swing with respect to each other.

The central pivot member 24 further comprises a pair of substantially vertically-oriented outer walls 30, 32 that extend rearwardly and generally outward from the outer lateral edges of the front wall 26. The outer walls 30, 32 of the central pivot member are preferably comprised of two angled wall portions 34, 36 and two rearward wall portions 38, 40 located rearward of the angled wall portions 34, 36. Each angled wall portion 34, 36 extends generally outwardly from the longitudinal axis of the central pivot member 24 and also extends generally rearwardly from the front wall of the central pivot member 24. The rearward wall portions 38, 40 of the outer walls 30, 32 are substantially vertically-oriented and laterally-spaced from each other and extend rearwardly from the rearmost edges of the angled wall portions 34, 36.

The central pivot member 24 also includes a substantially vertically-oriented rear wall 42 that extends substantially transversely between the rearward wall portions 38, 40 of the outer walls 30, 32. A slant wall 43 is preferably mounted between the outer walls 30, 32 below the rear wall 42 in a forwardly downward, rearwardly upward orientation. In the most preferred embodiment, a vertically-oriented central vertical wall 44 extends substantially transversely between the outer walls 30, 32, preferably at the location where the angled 34, 36 and rearward 38, 40 wall portions of the outer walls are joined together. A substantially horizontally-oriented top plate 46 and a substantially horizontally-oriented bottom plate 48 are preferably employed to join the outer walls 30, 32 and the front 26 and rear 42 walls together and thereby enclose the interior space within the central pivot member 24. This arrangement of the walls and plates provides a solid and strong box-like construction for the central pivot member 24 and gives the member 24 significant strength for resisting twisting of the member 24 between the central swing joint 20 and the pivot mounting 90 between the central pivot member 24 and the support structure 80.

The most preferred embodiment of the invention includes skid shoes for contacting a ground surface below the articulated dozer blade system 10. A skid shoe 51, 52 is mounted on the lower portions of each of the dozer blade portions 14, 16 in a position for contacting the ground below the blade portions. Significantly, a central skid shoe 50 is mounted on the bottom plate 48 of the central pivot member 24 for directly supporting the central pivot member 24 above the ground surface. Consequently, support of the central pivot member 24 is not solely imposed upon the shoes 51, 52 mounted on the dozer blade portions which may impose a twisting stress on the swing pin 23 of the central swing joint 20 which also may be transmitted to the central pivot member 24. The central skid shoe 50 is mounted on a post 54 which extends through the bottom plate 48 and also through the top plate 46 of the central pivot member 24, and is held in place by a removable post pin 56 which permits withdrawal of the post 54 from the central pivot member 24. Spacers, such as individual ring-shaped washers or ring bushings, may be placed between the bottom plate 48 and the skid shoe 50 to increase (or decrease by removing) the distance between the skid shoe 50 and the central pivot member 24 to adjust the ride height of the pivot member above the ground. The other skid shoes 51, 52 are similarly configurable for adjusting the ride height of the blade portions 14, 16.

The invention further includes blade positioning means for swinging each of the dozer blade portions 14, 16 relative to the central pivot member 24 to a user-selected position either at the forward swing position or the rearward swing position, or at a position between the forward and rearward positions. The blade positioning means for each dozer blade portion acts independently of the positioning means for the other blade portion such that, for example, one blade portion may be moved to the forward swing position and the other blade portion moved to the rearward swing position to push material encountered by the blade to one side. Similarly, placing both blade portions into the rearward swing position creates a V configuration that pushes material off to both sides of the articulated dozer blade and placing both blade portions into the forward swing position creates a reverse-V configuration.

Significantly, the blade positioning means is adapted to securely hold each the dozer blade portion 14, 16 in a user-selected position to thereby resist forward and rearward swinging of each of the dozer blade portions from the selected position. Thus, the blade portions are secured in their selected positions regardless of whether the dozer blade is being pushed forward by the vehicle along the ground surface or pulled rearward by the vehicle along the ground surface. This feature of the invention is critical in enabling the user of the dozer blade to "back-drag", or pull the blade rearwards over loose material to distribute and level out the material over an area of ground.

The preferred blade positioning means comprises a pair of elongate extendible/retractable members 58, 60 with each member acting on a dozer blade portion. Each extendible/retractable member 58, 60 has a selectively variable length independent of other extendible/retractable member acting on the other dozer blade portion. One end of each extendible/retractable member is mounted to a dozer blade portion and the other end of the extendible/retractable member is mounted to the central pivot member 24 such that extending the length of the extendible/retractable member swings the dozer blade portion toward the forward swing position. Conversely, retracting the extendible/retractable member swings the dozer blade portion toward the rearward swing position.

In the most preferred embodiment of the invention, each extendible/retractable member 58, 60 comprises a hydraulic cylinder comprising a piston rod 62 and a cylinder or barrel 64 with conduit means 66, 67 for hydraulically pressurizing either end of the cylinder 64 with fluid at either side of the piston such that the rod of the hydraulic cylinder assembly is hydraulically movable. The conduit means preferably comprises hydraulic hoses 66, 67 that are connected between the hydraulic cylinder and a hydraulic control valve (not shown) controlled by the operator of the vehicle. Ideally, the hydraulic control valve is electrically controlled by a control lever (not shown) operated by the vehicle operator. The preferred central pivot member 24 has a pair of spaced ears 68, 69 mounted on each of the outer walls 30, 32 for pivotally mounting one end of an extendible/retractable member 58, 60 to the central pivot member 24. Each dozer blade portion 14, 16 also has a pair of spaced mounting ears 70, 71 mounted thereon at a location laterally outward from the central swing joint 20 for mounting the other end of the extendible/retractable member 58, 60 to the dozer blade portion.

An important feature of the invention is the dozer blade support structure 80 for supportively attaching the articulated dozer blade 12 and the central pivot member 24 to a vehicle. The support structure 80 has a longitudinal axis parallel to the longitudinal axis of the central pivot member 24, and has a forward end 82 and a rearward end 84. In the most preferred embodiment of the invention, the support structure 80 is constructed of substantially parallel and laterally spaced square tubes 86, 88 that extend from the forward end 82 of the support structure to the rearward end 84 of the support structure.

A significant feature of the invention is the bifurcated pivot mounting 90 for pivotally mounting the central pivot member 24 (and the articulated dozer blade 12) on the support structure 80. On the central pivot member portion of the bifurcated pivot mounting 90, a pivot rod mounting sleeve 92 extends between and through the laterally-spaced outer walls 30, 32 so that the sleeve 92 is solid and continuous between the outer walls of the central pivot member 24. The mounting sleeve 92 is preferably fixedly mounted at its opposite end portions 94, 95 to the laterally-spaced outer walls 30, 32 with each end of the sleeve most preferably protruding through an outer wall. In the most preferred embodiment of the central pivot member 24, the rear wall 42 (positioned between the laterally-spaced outer walls 30, 32) extends vertically downward from the top plate 46 to the pivot rod mounting sleeve 92, and the bottom edge of the rear wall is fixed such as, for example, by welding to the pivot rod mounting sleeve 92.

The bifurcated pivot mounting 90 further comprises laterally-spaced parallel fork members 96, 97 on the support structure 80 that extend forwardly from the forward end 82 of the support structure. Each fork member 96, 97 has a pivot rod mounting bushing 98, 99 mounted thereon. The mounting bushings 98, 99 are aligned with each other such that the end portions of the pivot rod 100 are insertable in the mounting bushings with the central portion of the pivot rod 100 being unsupported between the fork members 96, 97, for being accepted within the pivot rod mounting sleeve 92.

The rear portion of the central pivot member 24 is positioned between the spaced fork members 96, 97 such that the pivot rod mounting sleeve 92 aligns with the pivot rod mounting bushings 98, 99 of the fork members. The pivot rod 100 is mounted with its end portions received in the pivot rod mounting bushings 98, 99 and it extends through the mounting sleeve 92 of the central pivot member 24 so that the central pivot member 24 may be pivoted with respect to the support structure 80.

Significantly, the fork members 96, 97 are located laterally outside of the outer walls 30, 32 of the central pivot member 24, which permits a larger spacing between the fork members 96, 97 and in turn provides greater resistance to twisting of the central pivot member 24 about a vertical axis with respect to the support structure 80. Forces that may impose a twisting of the central pivot member 24 include when the dozer blade 12 encounters an obstacle that is unevenly distributed between the blade portions 14, 16. One blade portion is thus subjected to a greater rearward force than the other blade portion, and as a result a torque is applied that tends to rotate the central pivot member 24 against the pivot mounting 90 and toward the blade portion having the greater load.

As a result of the pivot mounting 90 feature of the invention, the area of contact between the pivot rod 100 and the pivot rod mounting bushings 98, 99 is not limited by the area of contact between the pivot rod 100 and the pivot rod mounting sleeve 92. These areas of contact can be increased, and the stresses imposed on the elements of the pivot mounting can be spread out over a greater contact area, and therefore the concentration of stress at any one point of contact is reduced for longer life and greater reliability of the pivot mounting.

In the most preferred embodiment of the invention, the spacing between the fork members 96, 97 is at least about four inches or even larger to enable the pivot mounting 90 to provide greater resistance to the twisting torque forces that may be encountered. Illustratively, the fork members are about 6 inches apart and the mounting bushings 98, 99 are about 5 inches apart.

In the illustrative embodiment of the invention, the forward ends 82 of the spaced tubes 86, 88 of the support structure 80 form the spaced fork members 96, 97. Each pivot rod mounting bushing 98, 99 extends through both walls of the square tube, and the square tube has walls that are about three inches (or more) apart to provide greater stability in the mounting bushing 98, 99 and resistance to twisting forces.

The preferred support structure 80 includes pivot limiting means for limiting pivoting movement of the central pivot member 24 (and the articulated dozer blade 12) about the bifurcated pivot mounting 90. The pivot limiting means define two extreme positions for the central pivot member 24, with one being a normal or operational dozing position in which the articulated dozer blade 12 is positioned for dozing friable material in a forward or rearward direction. The other extreme position is a tripped position in which the blade 12 pivots downward from the operational dozing position to an obstacle encountered in the ground surface to pass by the edge of the blade portions 14, 16 with minimized opportunity for damage to the edge of the blade. Once the obstacle has passed, the blade portions 14, 16 return to the operational position.

The pivot limiting means includes upper pivot limiting means for preventing or limiting the upward pivotal movement of the central pivot member 24 (and the articulated dozer blade 12) beyond the operational dozing position. The preferred upper pivot limiting means includes an upper pivot limiting member 102 extending upwardly from the support structure 80 in a location adjacent to the fork members 96, 97. The upper pivot limiting member 102 includes a pair of longitudinally extending substantially parallel and spaced lateral walls 104, 106 having forward edges 105, 107 that align with the rearward edges 31, 33 of the outer walls 30, 32 of the central pivot member 24 such that pivoting movement of the central pivot member in an upward direction brings the rearward edges 31, 33 of the outer walls and the forward edges 105, 107 of the upper pivot limiting member 102 into abutment with each other thus blocking further pivot movement of the central pivot member. The forward edges 105, 107 of the pivot limiting member 102 thus present a surface against which the central pivot member 24 abuts when the central pivot member is in an operational dozing position.

In the most preferred embodiment of the upper pivot limiting member 102, at least one pivot locking tab 108 is provided for locking the central pivot member 24 against pivot movement with respect to the support structure 80, and thereby locking the position of the articulated dozer blade 12 with respect to the vehicle to which the support structure is attached. Preferably, a pair of pivot locking tabs 108, 109 are employed and are mounted so as to extend forwardly from the upper pivot limiting member 102 such that the tabs 108, 109 embrace a portion of the central pivot member 24, and ideally a tab is mounted to the outer surface of each of the lateral walls 104, 106 of the upper pivot limiting member. The pivot locking tabs 104, 106 are each provided with a locking aperture 110 therein, and the central pivot member 24 has a locking hole 112 in each of the outer walls. The locking apertures 110 and holes 112 are positioned so as to be aligned when central pivoting member 24 (and the articulated dozer blade 12) is in an operational dozing position. A pivot locking pin 114 is removably insertable through the locking apertures 110 of the pivot locking tabs 104, 106 and the locking holes 112 through the central pivot member's outer walls 30, 32 to produce a locking of the central pivot member 24 in an operational dozing position (and thereby preventing relative pivot movement between the central pivot member 24 and the support structure 80). Removal of the pivot locking pin 114 frees the central pivot member 24 and thus permits tripping of the articulated dozer blade.

The support structure 80 further includes lower pivot limiting means for limiting or blocking pivot movement of the central pivot member 24 with respect to the support structure 80 when the central pivot member is tripped by the articulated dozer blade 12 encountering an obstacle on the ground surface. The lower pivot limiting means preferably comprises a lower pivot limiting structure 116 formed by the lower portions of the forward edges 105, 107 of the left 104 and right 106 lateral walls of the upper pivot limiting member 102. The lower portions of the rearward edges 31, 33 of the outer walls 30, 32 contact the lower portions 116 of the lateral walls of the support structure 80.

The support structure 80 additionally comprises attachment means for attaching the support structure to a vehicle. Preferably the attachment means comprises an attachment frame 120 located at the rearward end 84 of the support structure 80. The most preferred attachment frame 120 has vertical walls 122, 123 with apertures therein for receiving fasteners for mounting the attachment frame 120 to a vehicle attachment platform (not shown), such as a standardized or uniform tool attachment frame. The attachment frame 120 also includes one or more horizontal plates 124, 125 extending between the vertical walls 122, 123 for reinforcing the vertical walls.

Another significant feature of the invention is the biasing means provided for biasing the central pivot member 24 into a desired pivot orientation with respect to the support structure, such as the operational dozing position. The preferred biasing means comprises a biasing assembly 130 having a plurality of biasing springs 132 mounted between the central pivot member 24 and the support structure 80 for resisting pivot movement of the central pivot member 24 out of the operational dozing position. The number of biasing springs 132 (or the resistance of the individual springs to extension) provided may be varied depending upon the desired resistance to pivot, which may be affected by the weight of the friable material to be moved by the dozer blade (e.g., the greater the density of the material to be moved, the greater the desired resistance to of the biasing assembly 130 to pivoting to prevent excessive tripping by the dozer blade 12).

In the most preferred biasing assembly 130, a number of biasing springs 132 are mounted laterally outward from one outer wall 30 of the central pivot member 24 and an equal number of biasing springs 132 are mounted laterally outward from the other outer wall 32 of the central pivot member 24 such that the biasing force produced by the biasing springs 132 is applied to the central pivot member 24 in a substantially balanced manner that resists rotation or twisting of the central pivot member with respect to the support structure 80 about an axis orthogonal to the axis of the pivot rod 100 (e.g., about a substantially vertical axis). In the illustrative embodiment, one half of the biasing springs 132 are located on one lateral side of the central pivot member 24 and the other half of the biasing springs 132 are located on the other lateral side of the central pivot member.

The preferred biasing assembly 130 includes a transversely-oriented upper spring mounting bar 134 mounted on the central pivot member 24, and illustratively comprises an angle member 136 fixed to the upper portion of the rearward edge 31, 33 of the outer walls 30, 32 of the central pivot member. The upper spring mounting bar 134 is provided for mounting one end of each biasing spring 132 of the biasing means to the central pivot member 24. A transversely-oriented lower spring mounting rod 138 is mounted on the support structure 80, and illustratively is mounted through apertures in the lateral walls 104, 106 of the upper pivot limiting member 102 (although other mounting locations may be employed). The lower spring mounting rod 138 is provided for mounting the opposite end of each biasing spring 132 of the biasing assembly 130 to the support structure. On the upper spring mounting bar 134, an eye bolt 140 is preferably mounted thereon for each biasing spring 132, and the eye bolt 140 has securing nuts mounted thereon to permit threadable adjustment of the projection of the eye bolt eye 140 from the mounting bar 134 to thereby increase or decrease the amount of tension imposed on each of the biasing springs 132 and thereby increase or decrease the resistance to tripping imposed by the biasing springs. The biasing springs 132 preferably have loops on their opposite ends to permit easy hooking and unhooking of spring ends from the eye hooks and the lower spring mounting rod 138.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An articulated dozer blade system for attachment to a vehicle, comprising:

an articulated dozer blade comprising left and right dozer blade portions pivotally mounted together at a central swing joint such that said dozer blade portions are swingable between a forward swing position and a rearward swing position, a central pivot member located rearward of said articulated dozer blade and having said central swing joint of said articulated dozer blade mounted thereon, said central pivot member having laterally spaced outer walls extending rearwardly from the mounting of said central swing joint, a dozer blade support structure for supportively attaching said dozer blade and said central pivot member to a vehicle, said support structure having a forward end and a rearward end, a bifurcated pivot mounting for pivotally mounting said central pivot member on said support structure, said bifurcated pivot mounting comprising a pivot rod mounting sleeve extending between said laterally-spaced outer walls of said central pivot member, said bifurcated pivot mounting further comprising laterally-spaced parallel fork members extending forwardly from the forward end of said support structure, each said fork member having a pivot rod mounting bushing mounted thereon, said central pivot member being positioned between said spaced fork members such that the pivot rod mounting sleeve thereof aligns with the pivot rod mounting bushings of said fork-members, and a pivot rod having end portions received in said pivot rod mounting bushings and extending through the mounting sleeve of said central pivot member, and an upper pivot limiting member extending upwardly from said support structure in a location adjacent to said fork members, said upper pivot limiting member including a substantially vertical surface against which said central pivot member abuts when said central pivot member is in an operational dozing position.

2. The articulated dozer blade system of claim 1 wherein said support structure further includes a lower pivot limiting member for limiting pivot movement of said central pivot member when said central pivot member structure is tripped by a ground obstacle.

3. The articulated dozer blade system of claim 1, wherein said central pivot member comprises a substantially vertically-oriented front wall having said central swing joint mounted thereon, said vertically-oriented front wall being substantially transversely oriented to the longitudinal axis of said central pivot member, a pair of substantially vertically-oriented angled walls extending outwardly and rearwardly from the outer lateral edges of said front wall, wherein each of said outer walls extending rearwardly from one of said angled walls, a substantially vertically-oriented rear wall extending substantially transversely between said outer walls, and a vertically-oriented central vertical wall extending substantially transversely between said outer walls, and a horizontally-oriented top plate and a horizontally-oriented bottom plate joining said outer walls to enclose the space within said central pivot member.

4. The articulated dozer blade system of claim 1, additionally comprising a pair of blade positioning actuators for independently swinging each said dozer blade portion relative to said central pivot member to a user-selected position between said forward swing position and said rearward swing position, said blade positioning actuators being adapted to securely hold each said dozer blade portion in a user-selected position to thereby resist forward and rearward swinging of a said dozer blade portion from said selected position.

5. An articulated dozer blade system for attachment to a vehicle, comprising:

an articulated dozer blade comprising left and right dozer blade portions pivotally mounted together at a central swing joint such that said dozer blade portions are swingable between a forward swing position substantially forward of said central swing joint and a rearward swing position substantially rearward of said central swing joint, a central pivot member located rearward of said articulated dozer blade and having said central swing joint of said articulated dozer blade mounted thereon, said central pivot member having laterally spaced outer walls extending rearwardly from the mounting of said central swing joint, blade positioning means for independently swinging each said dozer blade portion relative to said central pivot member to a user-selected position between said forward swing position and said rearward swing position, said blade positioning means being adapted to securely hold each said dozer blade portion in a user-selected position to thereby resist forward and rearward swinging of a said dozer blade portion from said selected position, a dozer blade support structure for supportively attaching said dozer blade and said central pivot member to a vehicle, said support structure having a forward end and a rearward end, said rearward end having attachment means for attaching said support structure to a vehicle, a bifurcated pivot mounting for pivotally mounting said central pivot member on said support structure, said bifurcated pivot mounting comprising a pivot rod mounting sleeve extending between and through said laterally-spaced outer walls of said central pivot member, said mounting sleeve being mounted at its opposite end portions to the laterally-spaced outer walls, said central pivot member having a rear wall extending between and being fixed to said laterally-spaced outer walls and being fixed to said pivot rod mounting sleeve, said bifurcated pivot mounting further comprising laterally-spaced parallel fork members extending forwardly from the forward end of said support structure, each said fork member having a pivot rod mounting bushing mounted thereon, said central pivot member being positioned between said spaced fork members such that the pivot rod mounting sleeve thereof aligns with the pivot rod mounting bushings of said fork members, and a pivot rod having end portions received in said pivot rod mounting bushings and extending through the mounting sleeve of said central pivot member and the mounting bushing of each said fork member; and pivot limiting means on said support structure for limiting pivoting of said central pivot member and said articulated dozer blade between an operational dozing position and a tripped position;

wherein said pivot limiting means comprises an upper pivot limiting member extending upwardly from said support structure in a location adjacent to said fork members, said upper pivot limiting member including a substantially vertical surface against which said central pivot member abuts when said central pivot member is in an operational dozing position.

6. The articulated dozer blade attachment of claim 5 additionally comprising biasing means for biasing said central pivot member about said pivot rod into a operational dozing position with respect to said support structure.

7. The articulated dozer blade system of claim 6 wherein said biasing means comprises a plurality of biasing springs mounted between said central pivot member and said support structure for resisting pivot movement of said central pivot member out of said operational dozing position, wherein one half of the plurality of said biasing springs is mounted laterally outward from one outer wall of said central pivot member and the other half of the plurality of said biasing springs is mounted laterally outward from the other said outer wall of said central pivot member such that the biasing force of said biasing springs is applied to said central pivot member in a substantially balanced manner that resists rotation of said central pivot member about an axis orthogonal to the axis of said pivot rod.

8. The articulated dozer blade system of claim 7 wherein said biasing means includes a transversely-oriented upper spring mounting bar mounted on said central pivot member for mounting one end of a biasing spring and a transversely-oriented lower spring mounting rod mounted on said support structure for mounting an opposite end of said biasing spring, and wherein each said biasing spring has one end mounted to said mounting bar and the other end mounted to the mounting rod.

9. The articulated dozer blade attachment of claim 5 wherein said blade positioning means comprises an elongate extendible/retractable member having a selectively variable length, one said end of said extendible/retractable member being mounted to a said dozer blade portion and the other said end of said extendible/retractable member being mounted to said central pivot member such that extending the length of said extendible/retractable member swings said dozer blade portion toward said forward swing position and retracting the extendible/retractable member swings said dozer blade portion toward said rearward swing position.

10. The articulated dozer blade system of claim 9 wherein each said extendible/retractable member comprises a hydraulically-actuated piston and cylinder assembly having conduit means for hydraulically pressurizing either end of the cylinder with fluid at either side of said piston such that the piston of said piston and cylinder assembly is hydraulically movable in said cylinder.

11. The articulated dozer blade system of claim 10 wherein said central pivot member has a pair of spaced ears mounted thereon for pivotally mounting one said end of a said extendible/retractable member to said central pivot member, and wherein each said dozer blade portion has a pair of spaced mounting ears mounted thereon at a location laterally outward from said central swing joint for mounting one said end of a said extendible/retractable member to said dozer blade portion.

12. The articulated dozer blade system of claim 5, wherein said central swing joint comprises a plurality of pivot sleeves, at least one said pivot sleeve being mounted on each said dozer blade portion and on the front wall of said central pivot member, and wherein said central pivoting joint further includes a swing pin inserted through the pivot sleeves to pivotally join said sleeves together.

13. The articulated dozer blade system of claim 5, wherein said central pivot member comprises a substantially vertically-oriented front wall having said central swing joint mounted thereon, said vertically-oriented front wall being substantially transversely oriented to the longitudinal axis of said central pivot member, a pair of substantially vertically-oriented angled walls extending outwardly and rearwardly from the outer lateral edges of said front wall, said outer walls extending rearwardly from said angled walls, a substantially vertically-oriented rear wall extending substantially transversely between said outer walls, and a vertically-oriented central vertical wall extending substantially transversely between said outer walls, and a horizontally-oriented top plate and a horizontally-oriented bottom plate joining said outer walls to enclose the space within said central pivot member.

14. The articulated dozer blade system of claim 5, wherein at least three skid shoes for contacting a ground surface, a skid shoe being mounted on the bottom plate of said central pivot member for supporting said central pivot member above the ground surface, the distance between said bottom plate and said skid shoe being adjustable to permit adjustment of the distance that said central pivot member rides above the ground surface.

15. The articulated dozer blade system of claim 5, wherein said support structure comprises substantially parallel laterally spaced tubes extending from the forward end to the rearward end of said support structure, and wherein the forward ends of said spaced tubes form said spaced fork members.

16. The articulated dozer blade system of claim 5, wherein said support structure additionally comprises an attachment frame at the rearward end of said support structure, said attachment frame having vertical walls having apertures therein for receiving fasteners for mounting said attachment frame to a vehicle.

17. The articulated dozer blade system claim 11 wherein said upper pivot limiting member has pivot locking tabs for locking said central pivot member against pivot movement with respect to said support structure, said pivot locking tabs extending forwardly from said upper pivot limiting member to embrace a portion of said central pivot member, said pivot locking tabs having locking apertures therein and said central pivot member having a locking hole therein such that said locking apertures and said locking hole are aligned when said articulated dozer blade is in an operational dozing position, and a pivot locking pin removably insertable through the locking apertures of said pivot locking tabs and the locking hole of said central pivot member to permit selective locking of said central pivot member in an operational dozing position.

18. The articulated dozer blade system of claim 5 wherein said upper pivot limiting member has pivot locking tabs for locking said central pivot member against pivot movement with respect to said support structure, said pivot movement with respect to said upper pivot limiting member to embrace a portion of said central pivot member, said pivot locking tabs having locking apertures therein and said central pivot member having a locking hole therein such that said locking apertures and said locking hole are aligned when said articulated dozer blade is in an operational dozing position, and a pivot locking pin removably insertable through the locking apertures of said pivot locking tabs and the locking hole of said central pivot member to permit selective locking of said central pivot member in operational dozing position.

19. The articulated dozer blade system of claim 5 wherein said support structure further includes a lower pivot limiting member for limiting pivot movement of said central pivot member when said central pivot member structure is tripped by a ground obstacle.

20. An articulated dozer blade system for attachment to a vehicle, comprising:

an articulated dozer blade comprising left and right dozer blade portions pivotally mounted together at a central swing joint such that said dozer blade portions are swingable between a forward swing position substantially forward of said central swing joint and a rearward swing position substantially rearward of said central swing joint;

a central pivot member located rearward of said articulated dozer blade and having said central swing joint of said articulated dozer blade mounted thereon, said central pivot member having laterally spaced outer walls extending rearwardly from the mounting of said central swing joint, said central pivot member comprising a substantially vertically-oriented front wall having said central swing joint mounted thereon, said vertically-oriented front wall being substantially transversely oriented to the longitudinal axis of said central pivot member, a pair of substantially vertically-oriented angled walls extending outwardly and rearwardly from the outer lateral edges of said front wall, substantially vertically-oriented and laterally-spaced outer walls extending rearwardly from said angled walls, a substantially vertically-oriented rear wall extending substantially transversely between said outer walls, and a vertically-oriented central vertical wall extending substantially transversely between said outer walls, and a horizontally-oriented top plate and a horizontally-oriented bottom plate joining said outer walls to enclose the space within said central pivot member;

said central swing joint comprising a plurality of pivot sleeves, at least one said pivot sleeve being mounted on each said dozer blade portion and on the front wall of said central pivot member, and wherein said central pivoting joint further includes a swing pin inserted through the pivot sleeves to pivotally join said sleeves together;

at least three skid shoes for contacting a ground surface, a skid shoe being mounted on the bottom plate of said central pivot member for supporting said central pivot member above the ground surface, the distance between said bottom plate and said skid shoe being adjustable to permit adjustment of the distance that said central pivot member rides above the ground surface;

blade positioning means for independently selectively swinging each said dozer blade portion relative to said central pivot member to a user-selected position between said forward swing position and said rearward swing position, said blade positioning means being adapted to securely hold each said dozer blade portion in a user-selected position to thereby resist forward and rearward swinging of a said dozer blade portion from said selected position, said blade positioning means comprising an elongate extendible/retractable member having a selectively variable length, one said end of said extendible/retractable member being mounted to a said dozer blade portion and the other said end of said extendible/retractable member being mounted to said central pivot member such that extending the length of said extendible/retractable member swings said dozer blade portion toward said forward swing position and retracting the extendible/retractable member swings said dozer blade portion toward said rearward swing position, wherein each said extendible/retractable member comprises a hydraulically-actuated piston and cylinder assembly having conduit means for hydraulically pressurizing either end of the cylinder with fluid at either side of said piston such that the piston of said piston and cylinder assembly is hydraulically movable in said cylinder, wherein said central pivot member has a pair of spaced ears mounted thereon for pivotally mounting one said end of a said extendible/retractable member to said central pivot member, and wherein each said dozer blade portion has a pair of spaced mounting ears mounted thereon at a location laterally outward from said central swing joint for mounting one said end of a said extendible/retractable member to said dozer blade portion;

a dozer blade support structure for supportively attaching said dozer blade and said central pivot member to a vehicle, said support structure having a forward end and a rearward end, said rearward end having attachment means for attaching said support structure to a vehicle, wherein said support structure comprises substantially parallel laterally spaced tubes extending from the forward end to the rearward end of said support structure, and wherein the forward ends of said spaced tubes form said spaced fork members;

pivot limiting means on said support structure for limiting pivoting of said central pivot member and said articulated dozer blade between an operational dozing position and a tripped position, said pivot limiting means comprising an upper pivot limiting member extending upwardly from said support structure in a location adjacent to said fork members, said upper pivot limiting structure including a substantially vertical surface against which said central pivot member abuts when said central pivot member is in an operational dozing position, wherein said upper pivot limiting member has pivot locking tabs for locking said central pivot member against pivot movement with respect to said support structure, said pivot locking tabs extending forwardly from said upper pivot limiting structure to embrace a portion of said central pivot member, said pivot locking tabs having locking apertures therein and said central pivot member having a locking hole therein such that said locking apertures and said locking hole are aligned when said articulated dozer blade is in an operational dozing position, and a pivot locking pin removably insertable through the locking apertures of said pivot locking tabs and the locking hole of said central pivot member to permit selective locking of said central pivot member in an operational dozing position, said support structure further including a lower pivot limiting member for limiting pivot movement of said central pivot member when said central pivot member structure is tripped by a ground obstacle, and an attachment frame at the rearward end of said support structure, said attachment frame having vertical walls having apertures therein for receiving fasteners for mounting said attachment frame to a vehicle; and a bifurcated pivot mounting for pivotally mounting said central pivot member on said support structure, said bifurcated pivot mounting comprising a pivot rod mounting sleeve extending between and through said laterally-spaced outer walls of said central pivot member, said mounting sleeve being mounted at its opposite end portions to the laterally-spaced outer walls, said central pivot member having a rear wall extending between and being fixed to said laterally-spaced outer walls and being fixed to said pivot rod mounting sleeve, said bifurcated pivot mounting further comprising laterally-spaced parallel fork members extending forwardly from the forward end of said support structure, each said fork member having a pivot rod mounting bushing mounted thereon, said central pivot member being positioned between said spaced fork members such that the pivot rod mounting sleeve thereof aligns with the pivot rod mounting bushings of said fork members, and a pivot rod having end portions received in said pivot rod mounting bushings and extending through the mounting sleeve of said central pivot member and the mounting bushing of each said fork member, biasing means for biasing said central pivot member about said pivot rod into a operational dozing position with respect to said support structure, wherein said biasing means comprises a plurality of biasing springs mounted between said central pivot member and said support structure for resisting pivot movement of said central pivot member out of said operational dozing position, wherein one half of the plurality of said biasing springs is mounted laterally outward from one outer wall of said central pivot member and the other half of the plurality of said biasing springs is mounted laterally outward from the other said outer wall of said central pivot member such that the biasing force of said biasing springs is applied to said central pivot member in a substantially balanced manner that resists rotation of said central pivot member about an axis orthogonal to the axis of said pivot rod, said biasing means including a transversely-oriented upper spring mounting bar mounted on said central pivot member for mounting one end of a biasing spring and a transversely-oriented lower spring mounting rod mounted on said support structure for mounting an opposite end of said biasing spring, and wherein each said biasing spring has one end mounted to said mounting bar and the other end mounted to the mounting rod.

* * * * *